US007131154B2

(12) United States Patent
Davis et al.

(10) Patent No.: US 7,131,154 B2
(45) Date of Patent: Nov. 7, 2006

(54) MOBILE TRANSPORT DEVICE

(75) Inventors: David T. Davis, Bethlehem, PA (US); Robert Novack, Cape Coral, FL (US)

(73) Assignee: Wood Lark Circle, Inc., Bethlehem, PA (US)

( * ) Notice: Subject to any disclaimer, the term of this patent is extended or adjusted under 35 U.S.C. 154(b) by 0 days.

(21) Appl. No.: 11/361,140

(22) Filed: Feb. 23, 2006

(65) Prior Publication Data

US 2006/0185089 A1 Aug. 24, 2006

Related U.S. Application Data

(60) Provisional application No. 60/656,033, filed on Feb. 24, 2005.

(51) Int. Cl.
*A47B 7/02* (2006.01)

(52) U.S. Cl. ..... 5/618; 297/322; 297/342; 297/354.13

(58) Field of Classification Search ..... 5/613, 5/616, 617, 610, 86.1, 618; 297/342, 322, 297/317
See application file for complete search history.

(56) References Cited

U.S. PATENT DOCUMENTS 1,398,203 A * 11/1921 Schmidt ..... 5/618
1,748,784 A 2/1930 Mierley
2,587,068 A 2/1952 Sanders
2,617,117 A * 11/1952 Putterbaugh ..... 5/616
2,682,913 A 7/1954 Scheide
2,694,437 A 11/1954 Glaser
2,869,614 A 1/1959 Wamsley
2,913,738 A 11/1959 Wise
3,147,039 A * 9/1964 Smith et al. ..... 297/90
3,198,576 A * 8/1965 Rosmarin ..... 297/342
3,284,093 A 11/1966 Engelmeier
3,344,445 A 10/1967 Crawford
3,379,450 A * 4/1968 Emerson et al. ..... 280/657
3,380,085 A * 4/1968 Ferneau et al. ..... 5/86.1
3,406,772 A 10/1968 Ahrent et al.
3,967,328 A 7/1976 Cox
4,039,223 A * 8/1977 Kristensson ..... 297/90
4,045,081 A * 8/1977 Ueno ..... 297/317
4,097,939 A * 7/1978 Peck et al. ..... 5/611
4,097,940 A * 7/1978 Tekulve et al. ..... 5/616
4,119,342 A * 10/1978 Jones ..... 297/80
4,190,913 A 3/1980 DiMatteo et al.
4,255,823 A 3/1981 Boyer et al.
4,361,917 A 12/1982 Wilson
4,381,571 A 5/1983 Elliott
4,432,359 A 2/1984 James
4,453,732 A 6/1984 Assanah et al.
4,607,883 A * 8/1986 Tzu-Chun ..... 297/317
4,660,884 A * 4/1987 Terui et al. ..... 297/317
4,717,169 A 1/1988 Shaffer
4,726,082 A 2/1988 DiMatteo et al.
4,767,148 A * 8/1988 Ferneau et al. ..... 296/20
4,787,104 A 11/1988 Grantham (Continued)

*Primary Examiner*—Patricia Engle
*Assistant Examiner*—Jonathan Liu
(74) *Attorney, Agent, or Firm*—Duane Morris LLP

(57) ABSTRACT

A convertible wheeled chair is easily changed by an attendant into a gurney of the same height as a patient bed. During the process of transferring a patient from an upright position to a reclining position, convertible wheeled chair shifts the center of gravity of the patient rearwardly, and therefore does not give the patient a sensation of sliding from the chair.

19 Claims, 11 Drawing Sheets

U.S. PATENT DOCUMENTS 4,821,352 A 4/1989 DiMatteo et al.
4,839,933 A 6/1989 Plewright et al.
4,856,123 A 8/1989 Henderson et al.
4,858,260 A * 8/1989 Failor et al. ..... 5/618
4,858,947 A * 8/1989 Yee et al. ..... 280/643
4,884,840 A * 12/1989 Linden et al. ..... 297/320
4,945,582 A * 8/1990 Hayton et al. ..... 5/610
4,966,379 A 10/1990 Mulholland
4,997,200 A 3/1991 Earls
5,048,133 A 9/1991 Iura et al.
5,136,742 A * 8/1992 Stebbins et al. ..... 5/618
5,154,438 A * 10/1992 Barclay ..... 280/250.1
5,179,745 A * 1/1993 Hebert et al. ..... 5/620
5,195,803 A * 3/1993 Quintile ..... 297/365
5,269,588 A * 12/1993 Kunz et al. ..... 297/322
5,722,682 A * 3/1998 Wang ..... 280/642
5,971,482 A 10/1999 Goertzen et al.
5,996,716 A 12/1999 Montigllo et al.
6,003,891 A 12/1999 Broadhead
6,089,593 A * 7/2000 Hanson et al. ..... 280/650
6,131,215 A * 10/2000 Lindell ..... 5/86.1
6,154,899 A * 12/2000 Brooke et al. ..... 5/81.1 R
6,158,810 A 12/2000 Galloway
6,185,769 B1 * 2/2001 Larisey et al. ..... 5/648
6,325,399 B1 * 12/2001 DeMoss ..... 280/250.1
6,336,235 B1 * 1/2002 Ruehl ..... 5/610
6,467,842 B1 * 10/2002 Lu ..... 297/316
6,505,365 B1 * 1/2003 Hanson et al. ..... 5/613
6,575,531 B1 * 6/2003 Tseng ..... 297/320
6,641,214 B1 * 11/2003 Veneruso ..... 297/322
6,715,831 B1 * 4/2004 Tseng ..... 297/281
6,789,847 B1 * 9/2004 Tsai ..... 297/342
6,799,770 B1 * 10/2004 Patrick et al. ..... 280/250.1
6,805,406 B1 * 10/2004 Jansen ..... 297/328
6,827,650 B1 * 12/2004 Tseng ..... 472/125
6,846,042 B1 * 1/2005 Hanson et al. ..... 297/411.36
2002/0059679 A1 * 5/2002 Weismiller et al. ..... 5/610
2004/0154097 A1 * 8/2004 Blevins ..... 5/81.1 R

* cited by examiner

MOBILE TRANSPORT DEVICE

This nonprovisional patent application claims priority from provisional patent application Ser. No. 60/656,033, filed Feb. 24, 2005, entitled Mobile Transport Device, which provisional application is incorporated herein by reference in its entirety.

FIELD OF THE INVENTION

The present invention generally relates to patient chairs and, more particularly to reclinable wheeled chairs which may be used to transfer a patient to a bed or from a bed to the wheeled chair.

BACKGROUND OF THE INVENTION

There are more than twenty-five million citizens in the United States who are temporarily or permanently totally disabled. These people reside in nursing homes, hospitals, rehabilitation facilities or in homes where they are totally dependent upon the care of others for their survival. Many of these people suffer from obesity and are unable to assist or only partially assist in their own care or handling. Many are confined to bed unless removed from their beds by attending persons. The typical method of removing a disabled person from a bed is to raise the disabled person to a sitting position, rotate the patient to a sitting position on the side of the bed and with an attendant under each arm and an attendant standing and facing the patient, stand or pick the patient up and then turn and lower the patient into a chair, wheelchair, geriatric chair, or on to some other conveying mechanism. The increase in such patients that are in excess of three hundred pounds in body weight has greatly exacerbated the foregoing methodology.

The result of physically handling disabled and obese persons is that many sustain spontaneous bone fractures, muscle and ligament pulls or tears, or pain solely from the physical handling and lifting. Another direct consequence of the existing practice outlined above is that the attendants suffer high incidents of injuries to their backs, muscles or ligaments as a result of physically lifting disabled, obese persons from sitting positions onto beds and returning them to their sitting positions. This consequence usually requires that institutions pay the highest workman's compensation insurance rates, and are required to hire additional attendants to perform the lifting and handling of disabled persons. In the home environment the consequence is that the disabled person is essentially confined to bed.

Thus, the problem is that millions of disabled obese persons in institutions or at home are being moved from beds to chairs or other appliances by the physical strength of their attendants with resulting injuries both to the patient and attendants; or the patient is never or seldom moved from the bed, with resulting bed sores, bad hygiene and circulatory problems. Such problems have greatly increased the cost of care of disabled persons through high insurance costs, additional labor, injuries and litigation.

Combined chair and gurney systems are well known in the art. For example, U.S. Pat. No. 2,587,068 shows a combined chair and gurney which is convertible from a chair to a gurney at the same height as a bed or operating table for transfer if desired. A frame supporting the patient is mounted for pivotal movement between various positions on a lower support frame mounted between wheels or casters. The seat supporting the patient remains in a horizontal position at all times and can not be inclined. Also, side frames are not provided alongside the seat at all times for support of the patient.

U.S. Pat. No. 3,147,039, shows a combined wheelchair and gurney which is convertible for transport of a patient either in a sitting or lying position. A pair of side frames are provided to support a linkage for converting the transportation of a patient between a sitting position and a lying position. The back seat frame and the leg seat frame are both connected to and supported by the opposed side frames, and the seat frame remains positioned horizontally at all times.

U.S. Pat. No. 4,717,169, discloses the concept of a wheeled structure that is readily convertible between a full-sized bed and a wheelchair. This is different from the teachings of the present invention in that the unit does not include any mechanism to facilitate a rearward shifting of the patient's center of gravity, or transferring the patient from the bed arrangement onto another like bed.

U.S. Pat. No. 4,787,104, discloses the concept of a convertible hospital bed that includes mechanism to assist moving a patient that is in the bed into a sitting position and off the bed. These teachings are only generally related to the present invention, and fail to include a wheelchair unit that is convertible into a gurney or the concept of a rearward shift of a patient's center of gravity.

U.S. Pat. No. 4,821,352, discloses an arrangement combining a wheelchair with a bed, wherein the bed has mechanism that assists in lifting an invalid from the bed into a wheelchair with the wheelchair having a mechanism to receive the invalid from the bed. The wheelchair unit is different from that of the present invention since it fails to include structures which include any mechanism to facilitate a rearward shift of the patient's center of gravity, or permit transfer of an invalid between a bed and a convertible wheelchair, where the convertible wheelchair is located adjacent the side of the bed.

Reclinable wheeled chairs are also known in the art, for example, U.S. Pat. Nos. 1,748,784; 2,587,068; 2,682,913; 2,694,437; 2,869,614; 2,913,738; 3,147,039; 3,284,093; 3,344,445; 3,406,772; 3,967,328; 4,190,913; 4,255,823; 4,285,541; 4,361,917; 4,381,571; 4,432,359; 4,453,732; 4,717,169; 4,726,082; 4,787,104; 4,839,933; 4,856,123; 4,858,260; 4,966,379; 4,997,200; 5,048,133; 5,971,482; 5,996,716; 6,003,891; and 6,158,810 disclose various wheeled chairs, many of which focus shifting the orientation of a patient from a seated position to a supine or prone position to aid in patient care. These prior art wheeled chairs provide transportation and mobility to patients, while allowing the patient to recline to a prone position for comfort. Although conventional wheeled chairs provide the above-mentioned features, conventional wheeled chairs have limited capabilities.

For example in many of the foregoing prior art devices the process of transitioning a patient from an upright, seated position to a supine, prone position relies upon a seat structure that relies upon a "parallelogram" linkage to effect the transition. Since the length relationship among the links always remains a constant during operation of such prior art "parallelogram" linkage-based seats, a shift in the center of mass of the patient outwardly very often results, giving the patient a sensation of sliding from the chair. This sensation is disconcerting to the obese patient, and thus often requires more than one caregiver, and great effort by the patient, to maintain the patient's sense of safety during transition from sitting to reclining or vice-a-versa.

What is needed in the art is a wheeled chair, which provides a simple, safe, and cost-effective way of transitioning a patient from an upright, seated position to a supine, prone position and vice versa. What is also needed is a wheeled chair and gurney combination, which simplifies the patient transfer process and enhances the safety of that process.

SUMMARY OF THE INVENTION

The present invention provides a convertible wheeled chair that is easily changed by an attendant into a gurney of the same height as a patient bed. During the process of transferring a patient from an upright position to a reclining position, the present invention shifts the center of gravity or mass of the patient rearwardly, and therefore does not give the patient a sensation of sliding from the chair. Also the present invention may be tilted or reclined backward so as to provide for increased blood flow to the upper regions of the patient's body during initial treatment of trauma.

In one embodiment, a convertible chair is provided that is adapted to be transformed from a first position suitable for supporting a seated patient to a second position suitable for supporting reclining patient at the same height as a patient bed. The convertible chair includes a pair of spaced-apart side frames and a back frame including a pair of spaced-apart support members each having an axially off-set extension located at a bottom end. A seat frame is pivotally supported upon the pair of spaced-apart side frames. The seat frame includes a pair of spaced-apart telescoping beams arranged in substantially parallel relation to the pair of spaced-apart side frames. Each of the telescoping beams has a front end and a rear end, and is capable of changing length. Each of the front ends is pivotally mounted upon a portion of an adjacent side frame, and each of the rear ends is pivotally mounted upon a portion of a respective one of the axially off-set extensions. A pair of spaced-apart lower link beams each has a front end and a rear end that are each pivotally engaged with a respective one of the telescoping beams by a front toggle beam and a rear toggle beam, respectively. A powered drive is operatively supported between the pair of spaced-apart side frames and operatively engaged with the seat frame so as to move the seat frame and the back frame between (i) a first position where the seat frame and the back frame are oriented so as to be suitable for supporting a seated patient. In this position, the telescoping beam is at its shortest length. Additionally, the powered drive operatively engages the seat frame so as to move it to a second position where the seat frame and the back frame are oriented so as to be suitable for supporting a reclining patient at the same height as a patient bed. In this position, the telescoping beam is at its longest length.

The convertible chair is designed to allow a disabled patient to be slipped or turned from the surface of a bed onto the convertible wheeled chair in its gurney position, then gently lowered into an infinitely adjustable sitting and/or reclining position. When the disabled person has medical, physical, or hygienic needs, the attendant simply and easily raises the disabled person to the horizontal gurney position, attends to those needs, and then simply and easily lowers the patient to a desired sitting or reclining position.

Patients benefit from use of the convertible wheeled chair because they are never physically lifted by attendants with the possible resulting injuries, and the patients can be kept much cleaner because of the ease and frequency with which they can be administered. In addition, patients benefit because they frequently move, thereby eliminating pressure points which cause bed sores. A post-operative patient also benefits from the changing sitting/reclining/horizontal positions in that the circulatory system of the patient is exercised by a frequent, yet gentle movement.

BRIEF DESCRIPTION OF THE DRAWINGS

These and other features and advantages of the present invention will be more fully disclosed in, or rendered obvious by, the following detailed description of the preferred embodiment of the invention, which is to be considered together with the accompanying drawings wherein like numbers refer to like parts and further wherein.

DETAILED DESCRIPTION OF THE PREFERRED EMBODIMENT

Figure 1:
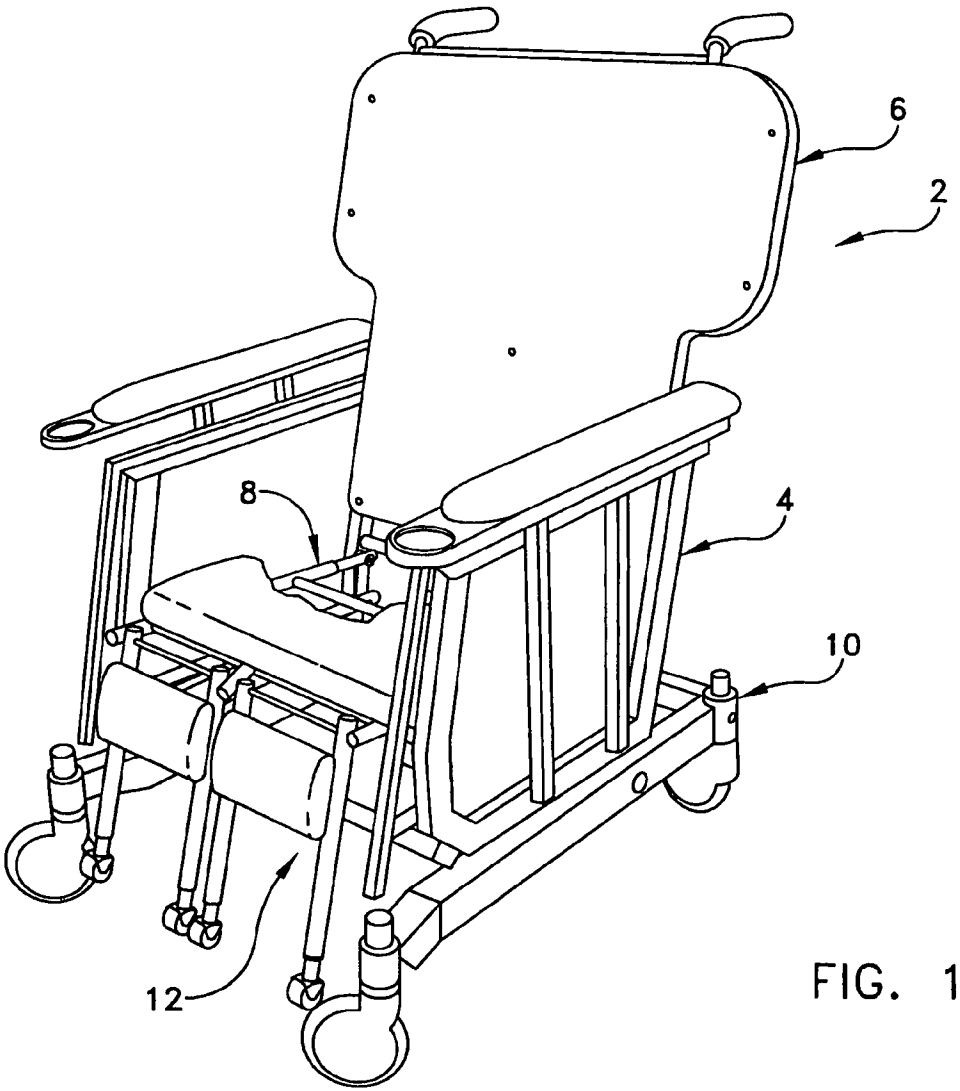
FIG. 1 is a perspective view of a mobile transport device formed in accordance with the present invention.
Figure 2:
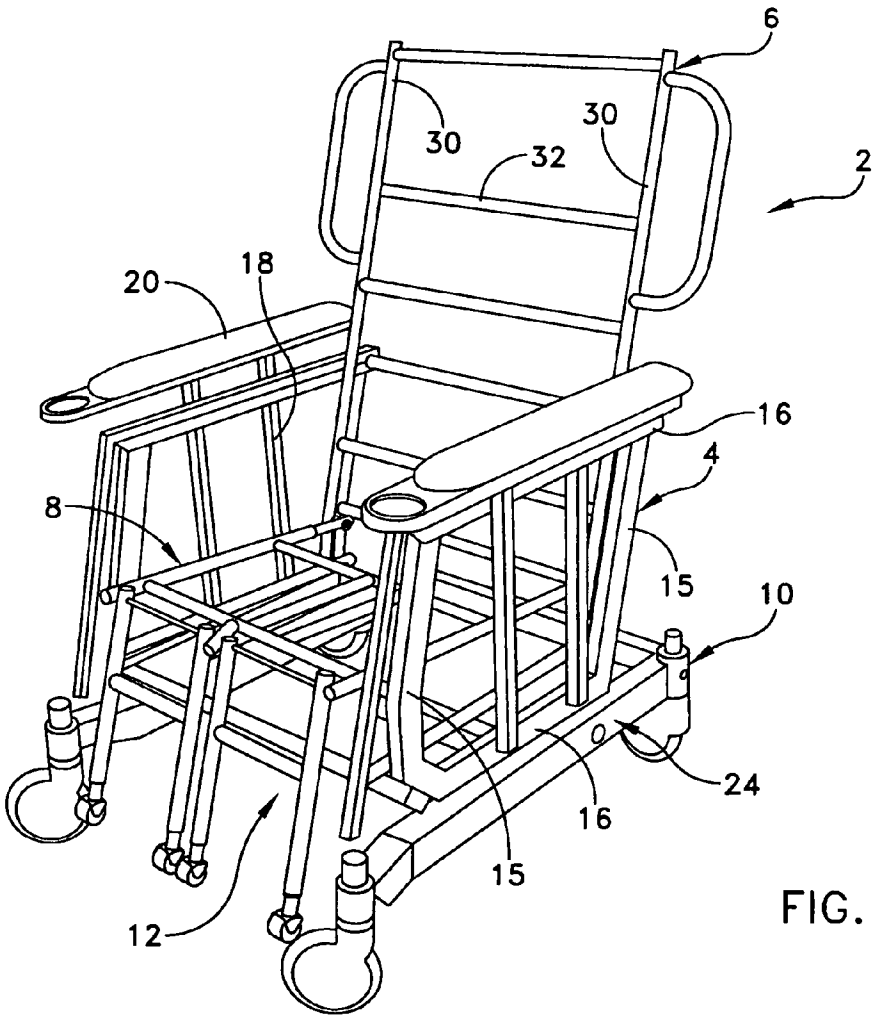
FIG. 2 is a perspective view of the mobile transport device shown in FIG. 1 having portions of the super structure removed for clarity of illustration.
Figure 3:
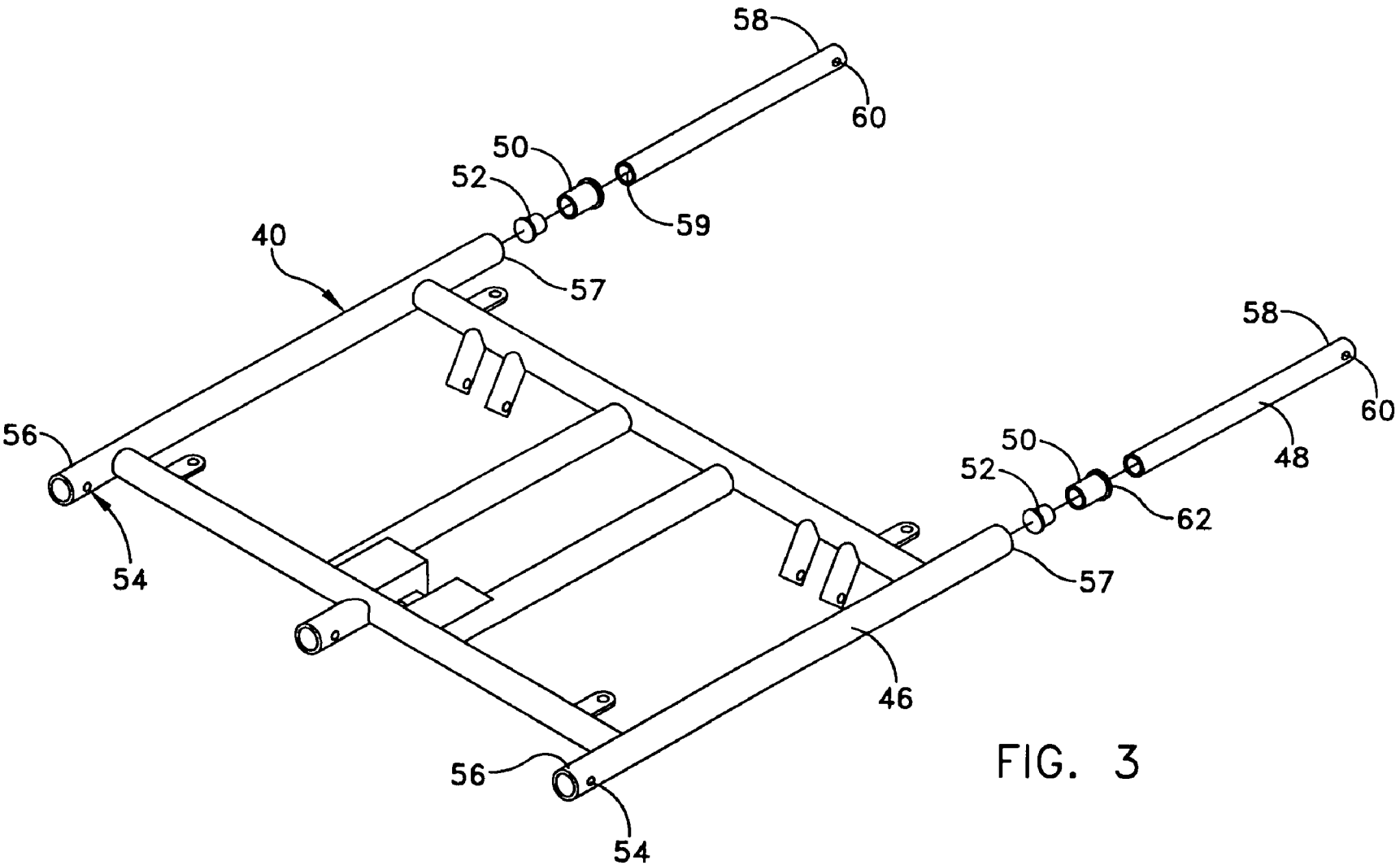
FIG. 3 is an exploded, perspective view of a telescoping beam assembly formed in accordance with the present invention.
Figure 4:
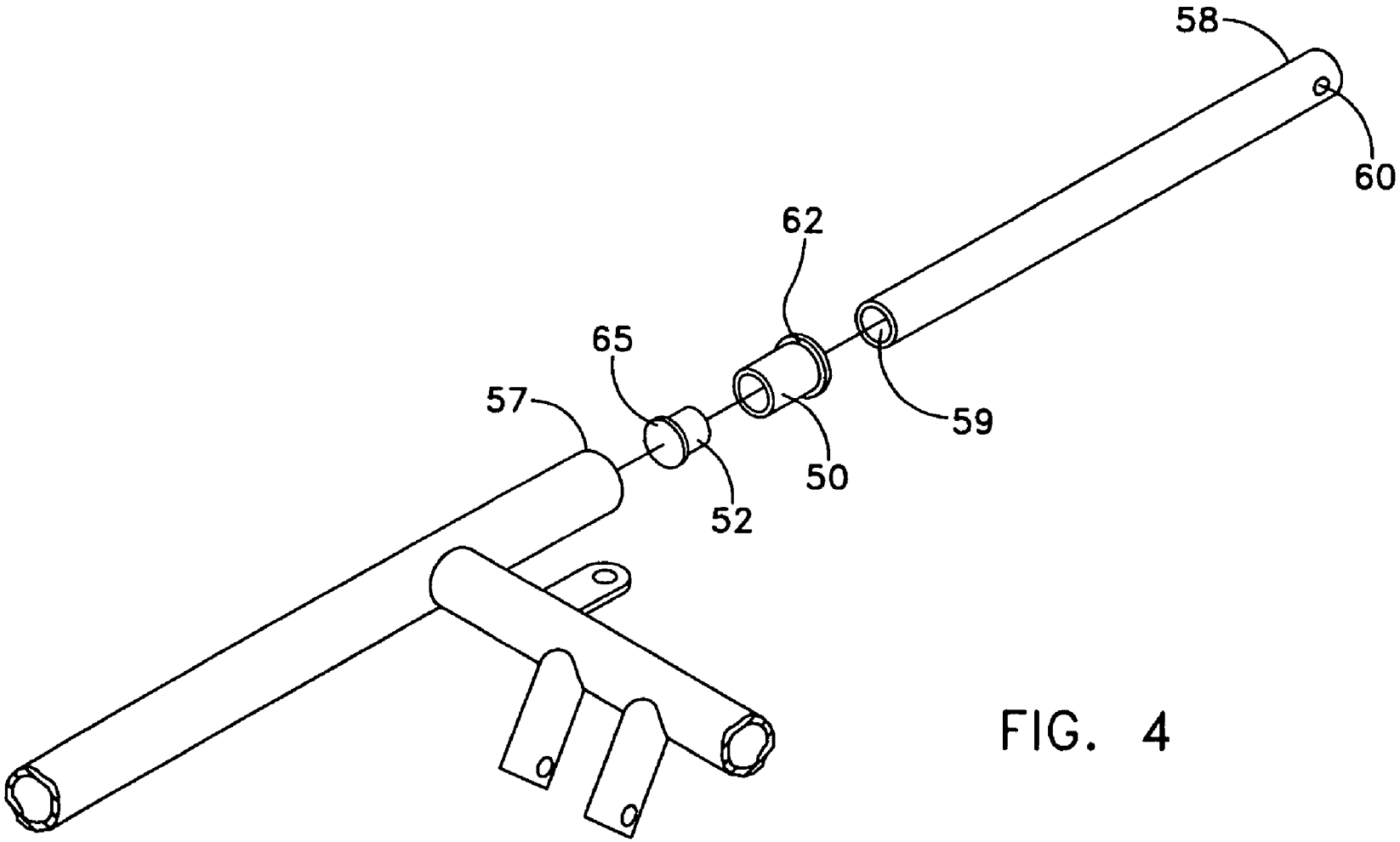
FIG. 4 is an exploded, perspective and broken-away view of a portion of the telescoping beam assembly shown in FIG. 3.

This description of preferred embodiments is intended to be read in connection with the accompanying drawings, which are to be considered part of the entire written description of this invention. The drawing figures are not necessarily to scale and certain features of the invention may be shown exaggerated in scale or in somewhat schematic form in the interest of clarity and conciseness. In the description, relative terms such as "horizontal," "vertical," "up," "down," "top" and "bottom" as well as derivatives thereof (e.g., "horizontally," "downwardly," "upwardly," etc.) should be construed to refer to the orientation as then described or as shown in the drawing figure under discussion. These relative terms are for convenience of description and normally are not intended to require a particular orientation. Terms including "inwardly" versus "outwardly," "longitudinal" versus "lateral" and the like are to be interpreted relative to one another or relative to an axis of elongation, or an axis or center of rotation, as appropriate. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise. The term "operatively connected" is such an attachment, coupling or connection that allows the pertinent structures to operate as intended by virtue of that relationship. In the claims, means-plus-function clauses, if used, are intended to cover the structures described, suggested, or rendered obvious by the written description or drawings for performing the recited function, including not only structural equivalents but also equivalent structures.

Referring to FIGS. 1–4, the present invention provides a mobile transport device 2 that is convertible between a chair in which a patient may be arranged in a seated position and a tiltable gurney with the patient in a supine or prone position. Mobile transport device 2 includes a pair of side frames 4, a back frame 6, a seat frame 8, a transport frame 10 and powered drive assemblies 12. More particularly, each side frame 4 includes a two spaced-apart vertical support members 15 and two spaced-apart transverse support members 16 joined at their respective ends so as to form an open frame. One or more vertical beams 18 may extend between spaced-apart transverse support members 16 so as to provide structural integrity sufficient to support the weight of a three hundred pound to six hundred pound patient. Arm rests 20 are positioned atop upper ones of the spaced-apart transverse support members 16. A pivot joint 24 is located in each lower rear corner of each side frame 4 and arranged in confronting, coaxial relation to one another (FIGS. 2 and 9–11).

Figure 6:
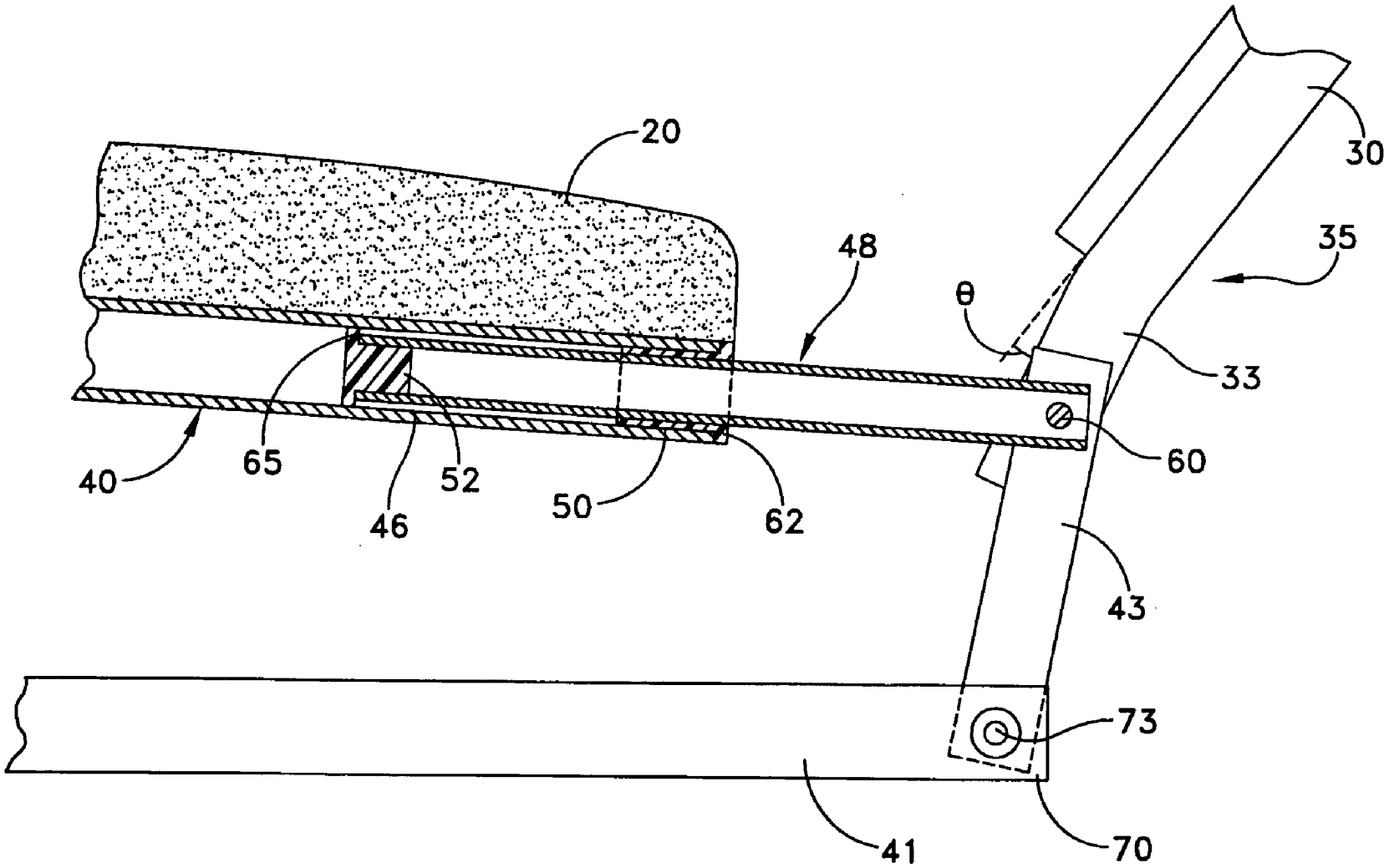
FIG. 6 is a broken-away and partially cross-sectional side elevational view of the portions of the back frame and seat frame shown in FIG. 5.
Figure 7:
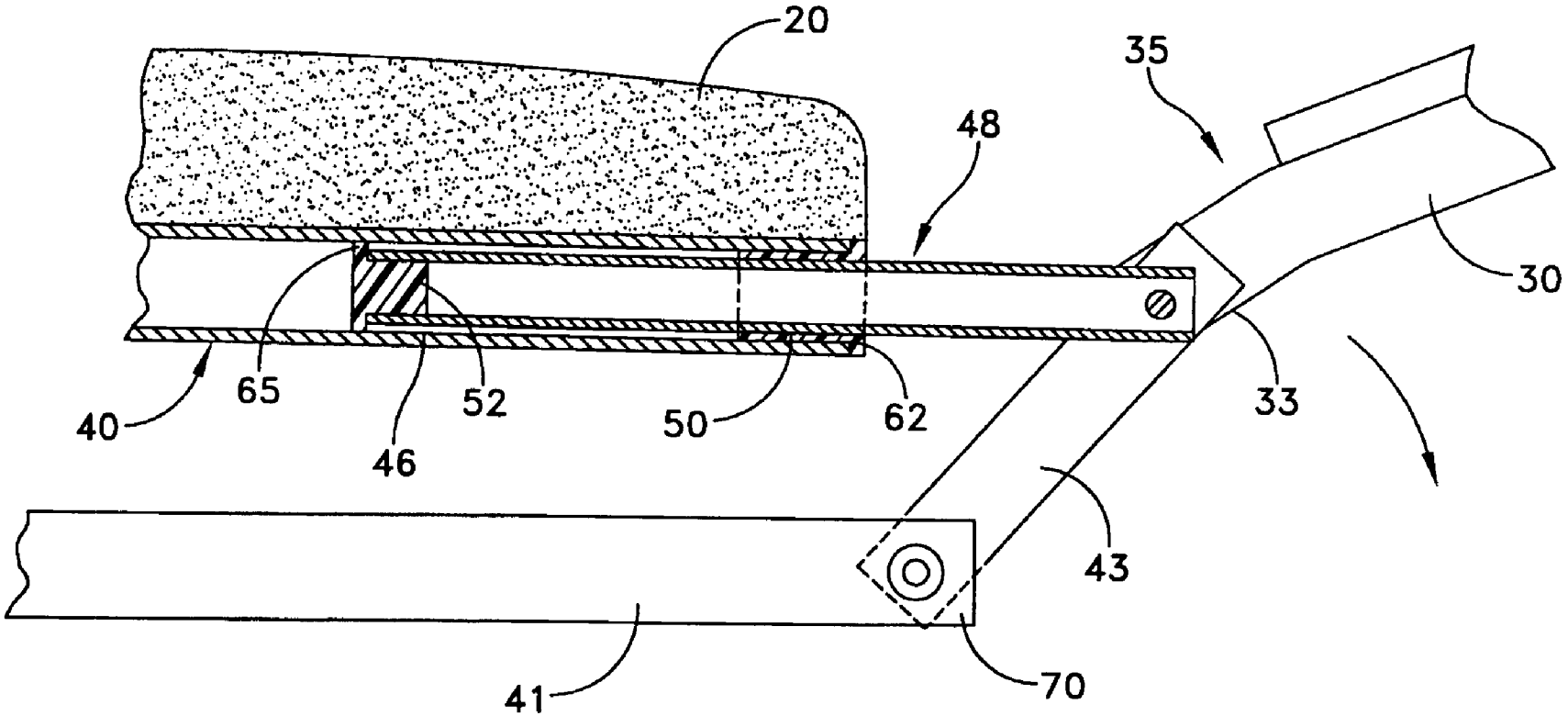
FIG. 7 is a broken-away and partially cross-sectional view similar to FIG. 6 showing a telescoping beam assembly in operation during the movement of a back frame in accordance with the present invention.
Figure 8:
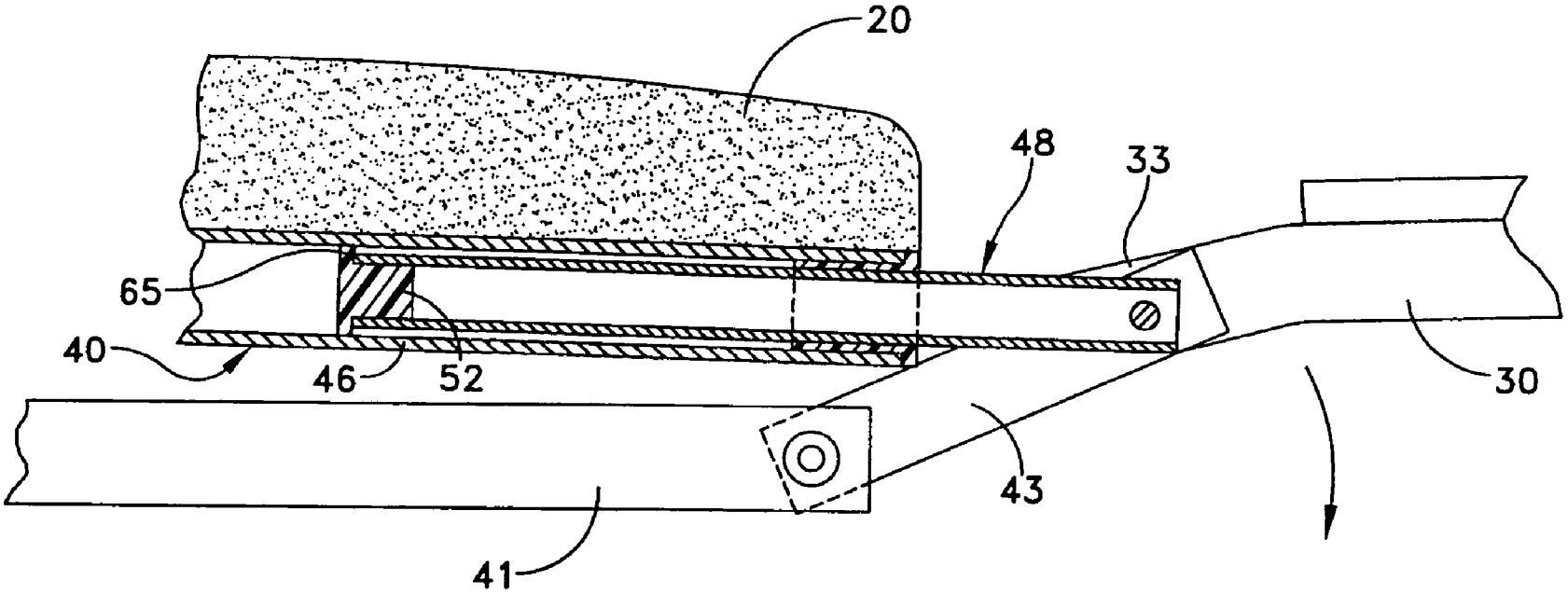
FIG. 8 is a broken-away and partially cross-sectional view similar to FIGS. 6 and 7 further illustrating the actuation of the present invention.
Figure 9:
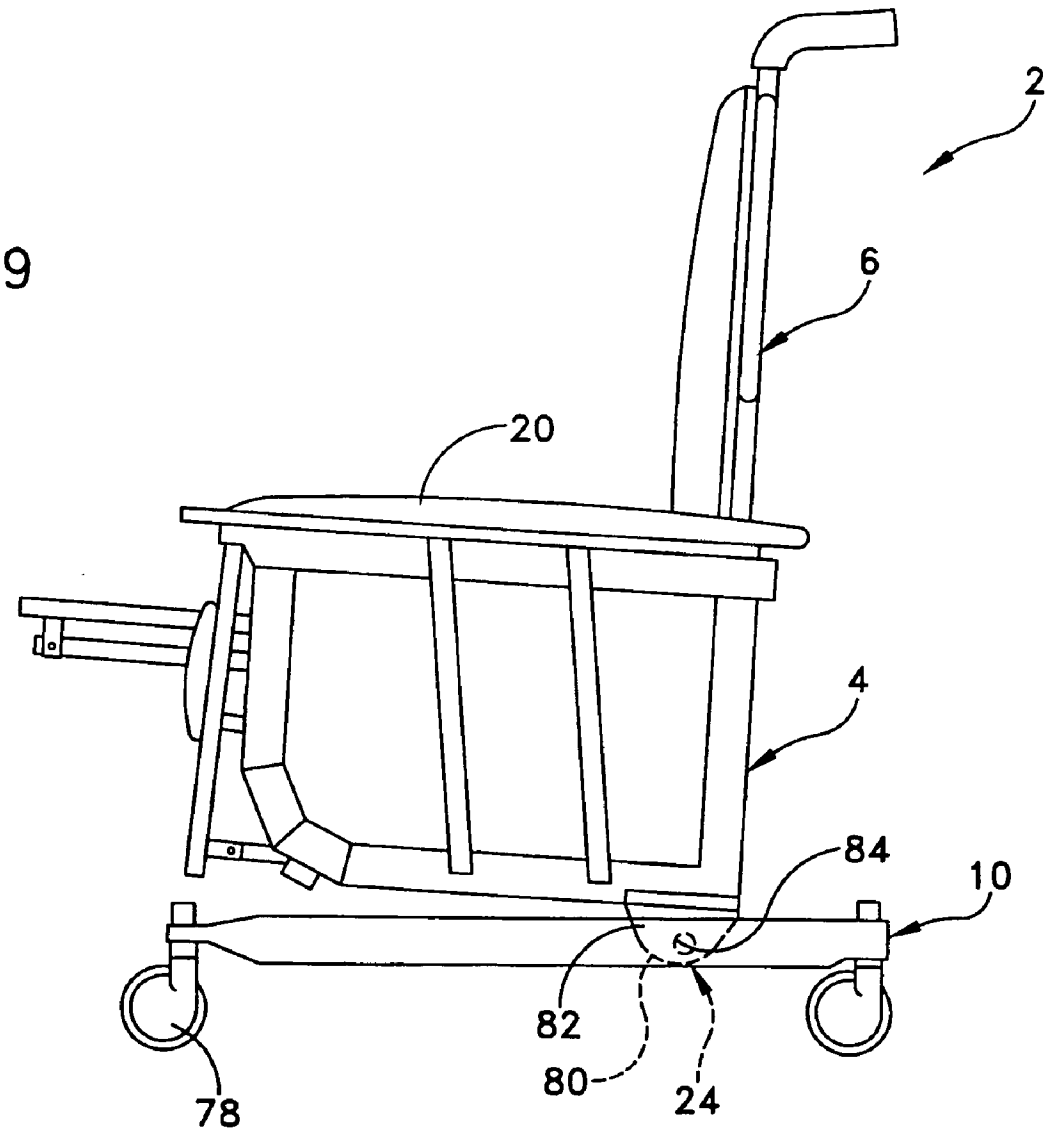
FIG. 9 is a side elevational view of the mobile transport device formed in accordance with the present invention.

Back frame 6 includes two spaced-apart vertical support members 30 and a plurality of spaced-apart transverse support members 32 that are arranged in parallel spaced relation to one another between vertical support members 30, and are joined at their respective ends to portions of vertical support members 30. An axially off-set extension beam 33 (FIG. 6) is arranged adjacent to each bottom end 35 of each vertical support members 30 (FIGS. 6, 7, and 8). A transverse pivot hole 36 is located in each off-set extension beam 33. Pivot holes 36 are arranged in confronting, coaxial relation to one another. Off-set extension beams 33 are preferably arranged on end portions 35 of vertical support members 30 so as to extend outwardly at an angle Θ of between about 5° and about 12° from the longitudinal axis of vertical support members 30.

Figure 5:
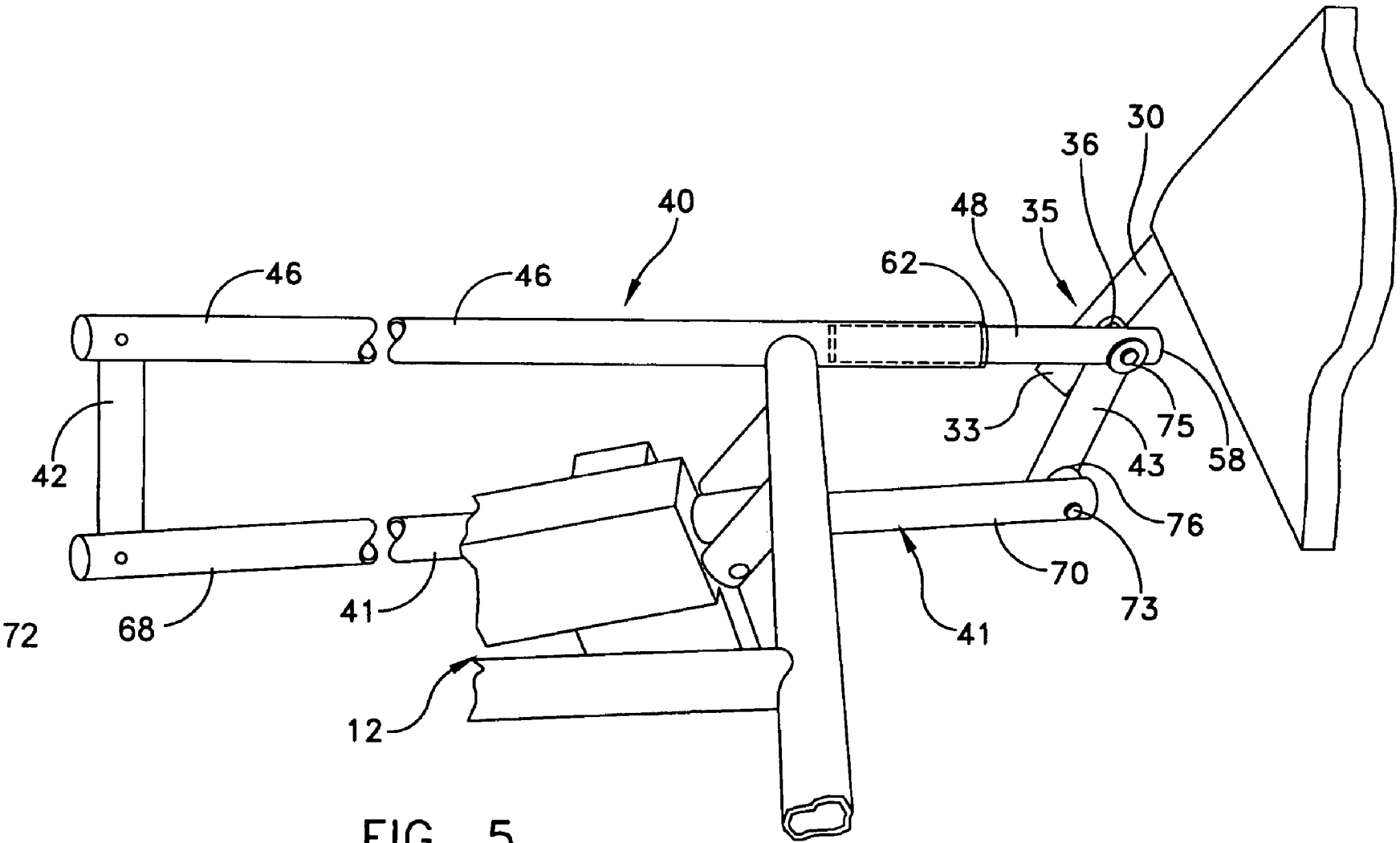
FIG. 5 is a perspective broken-away portion of a seat frame and back frame formed in accordance with the present invention.

Referring to FIGS. 2–8, seat frame 8 is positioned between side frames 4 and at the lower end of back frame 6, and includes a pair of spaced-apart telescoping beam assemblies 40, a pair of spaced-apart lower link beams 41, and a pair of toggle beams 42 (FIG. 5). Each telescoping beam assembly 40 includes a hollow support tube 46, a slide tube 48, a tubular journal 50, and a plug 52. Hollow support tubes 46 include a transverse pivot hole 54 adjacent to a front end 56 and spaced-away from a back end 57. Hollow slide tube 48 has an outer diameter that is smaller than the internal diameter of both tubular journal 50 and hollow support tube 46, while tubular journal 50 has an outer diameter that is slightly smaller than the internal diameter of hollow support tube 46. Slide tube 48 includes a front end opening 59 and a back end 58, and includes a transverse pivot hole 60 adjacent to a back end 58. Tubular journal 50 includes an annular lip 62 disposed at one end that has an outer diameter that is larger than the internal diameter of hollow support tube 46. In this way, slide tube 48 can be slidingly positioned within tubular journal 50, and both can be received at back end 57 of hollow support tube 46 so that slide tube 48 can be slid axially within hollow support tube 46 guided by tubular journal 50. Plug 52 includes an annular lip 65 disposed at one end that has an outer diameter that is larger than the internal diameter of slide tube 48, but smaller than the internal diameter of hollow support tube 46, and is positioned in front end opening 59 of slide tube 48.

Each lower link beam 41 comprises a rod having a front end 68, a rear end 70, and a pair of spaced-apart transverse pivot holes 72, 73 located adjacent to front end 68 and rear end 70, respectively. Lower link beam 41 is often hollow, and has a length that is approximately equal to the fully contracted length of telescoping beam assembly 40. Front toggle beam 42 and rear toggle beam 43 are nominally shorter than either lower link beam 41 or a fully contracted telescoping beam assembly 40, and each include spaced-apart transverse pivot holes 75, 76.

Figure 10:
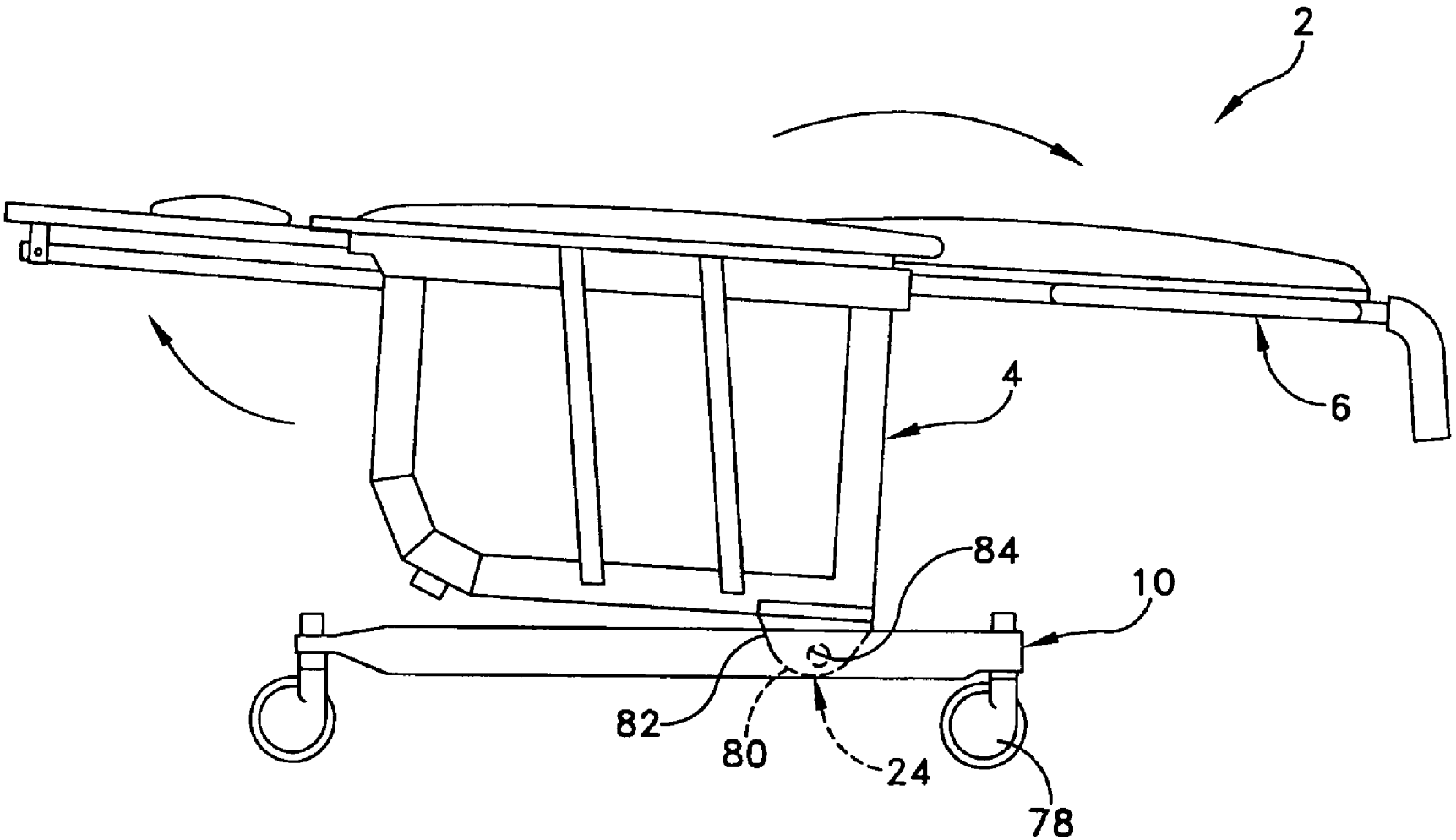
FIG. 10 is a side elevational view of the mobile transport device formed in accordance with the present invention, in a supine position.
Figure 11:
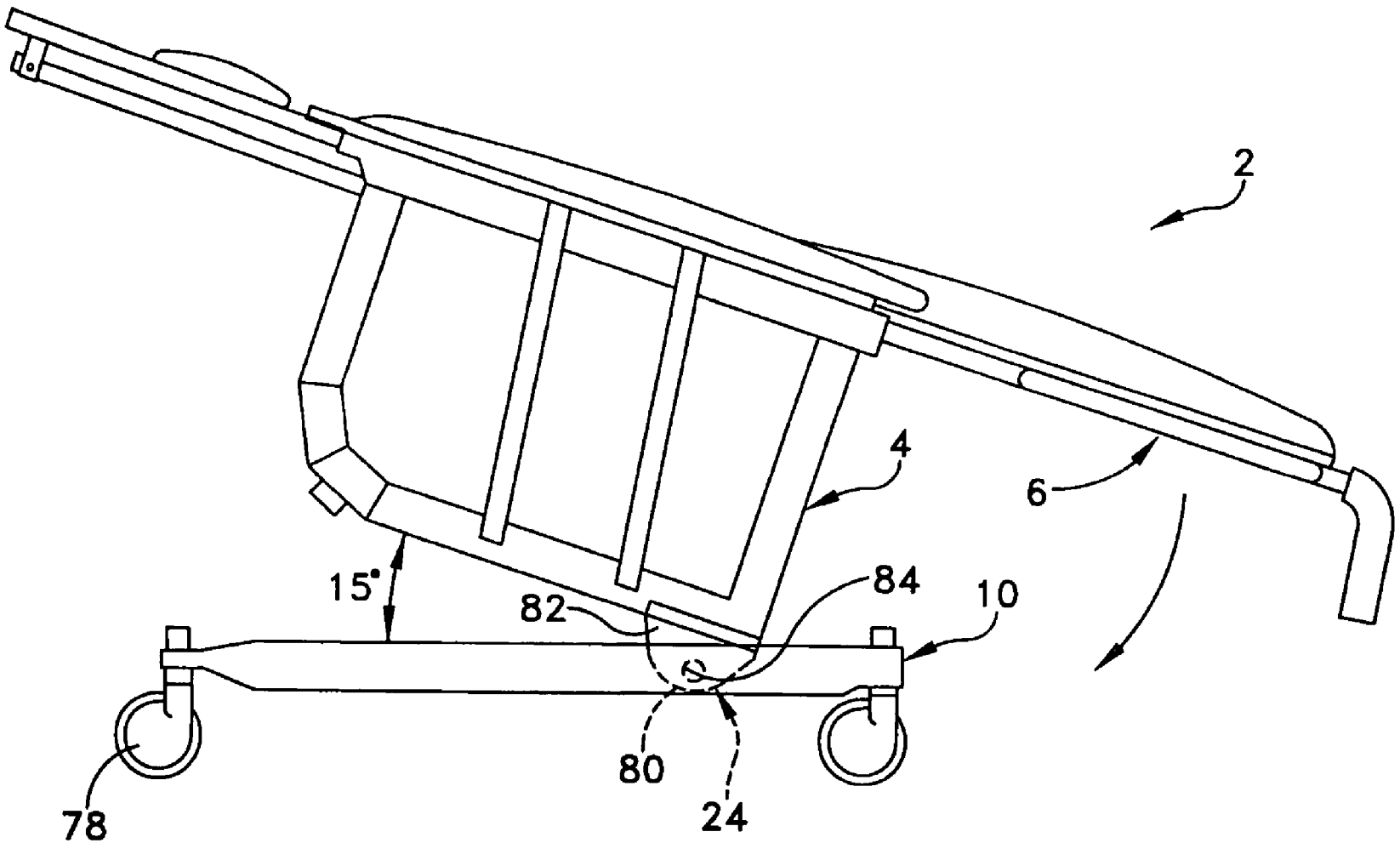
FIG. 11 is a side elevational view of a mobile transport device similar to that shown in FIG. 10, in a tilted position.

A mobile transport device 2 may be assembled and operated in the following manner. Transport frame 10 supports side frames 4 and back frame 6, and includes three or four wheels 78. A pair of coaxial, spaced-apart pivot holes 80 are located in the rear portion of frame 10. A pivot bracket 82 that is fixed in a rear portion of lower transfer support member 16 of side frames 4 pivotally fastens side frames 4 to transport frame 10 via a pivot pin 84. In this way, the chair/gurney portion of mobile transport device 2 can be tilted rearwardly about pivot pin 84 so as to be approximately 15° relative to transport frame 10 (FIGS. 10 and 11).

To convert mobile transport device 2 from a chair to a gurney, seat frame 8 is driven by drive assembly 12 in the form of an electric motor (not shown) that engages a portion of lower link beam 41. It will be understood that while mobile transport device 2 is arranged in an upright position that is suitable for supporting a seated patient, the telescoping beam assembly 40 resembles a parallelogram (FIG. 5). However, as lower link beam 41 is moved forwardly, front toggle beam 42 and rear toggle beam 43 pivot about pivot holes 72, 73 and 60. As this occurs, telescoping beam assemblies 40 lengthen relative to link beam 41, changing the shape of telescoping beam assembly from substantially a parallelogram to substantially non-parallelogram in shape. More particularly, hollow support tube 46 is drawn away from slide tube 48 such that lip 65 of plug 52 moves along the internal surface of hollow support tube 46. Advantageously, since the structure of seat frame 8 does not remain in a parallelogram shape, due to the growth in length of telescoping beam assemblies 40, the angular axial offset of extension 33 at the bottom end 35 of vertical support members 30 provides for a shifting of the center of gravity of the person seated in mobile transport device 2 rearwardly so as to provide a comfortable, non-sliding sensation to that person as they transition from a seating position to a reclining, supine or prone position on mobile transport device 2.

It is to be understood that the present invention is by no means limited only to the particular constructions herein disclosed and shown in the drawings, but also comprises any modifications or equivalents within the scope of the claims.

What is claimed is:

1. A mobile transport device adapted to be transformed from a first position suitable for supporting a seated patient to a second position suitable for supporting a reclining patient at the same height as a patient bed comprising:

a pair of spaced-apart side frames;

a back frame including a pair of spaced-apart support members each having an axially off-set extension located at a bottom end;

a seat frame pivotally supported upon said pair of spaced-apart side frames, said seat frame including a pair of spaced-apart telescoping beams arranged in substantially parallel relation to said pair of spaced-apart side frames, each of said telescoping beams having a front end and a rear end and include a hollow support tube having a slide tube supported within by a tubular journal that is located within an open end of said hollow support tube, said hollow support tube including a transverse pivot hole adjacent to a front end and spaced-away from a back end such that said hollow slide tube has an outer diameter that is smaller than an internal diameter of both said tubular journal and said hollow support tube, while said tubular journal has an outer diameter that is slightly smaller than an internal diameter of said hollow support tube so that each of said telescoping beams are capable of changing length wherein each of said front ends is pivotally mounted upon a portion of an adjacent side frame, and each of said rear ends is pivotally mounted upon a portion of a respective one of said axially off-set extensions;

a pair of spaced-apart lower link beams each having a front end and a rear end that are each pivotally engaged with a respective one of said telescoping beams by a front toggle beam and a rear toggle beam; and a powered drive operatively supported between said pair of spaced-apart side frames and operatively engaged with said seat frame so as to move said seat frame and said back frame between (i) said first position wherein said seat frame and said back frame are oriented so as to be suitable for supporting a seated patient, wherein said telescoping beam is at its shortest length; and (ii) said second position wherein said seat frame and said back frame are oriented so as to be suitable for supporting a reclining patient at the same height as a patient bed wherein said telescoping beam is at its longest length.

2. A mobile transport device according to claim 1 wherein said a pair of spaced-apart side frames are supported upon a wheeled transport frame.

3. A mobile transport device according to claim 2 wherein said pair of spaced-apart side frames are pivotally supported upon a wheeled transport frame so as to provide for rearward tilting of said seat frame and said back frame.

4. A mobile transport device according to claim 3 wherein said rearward tilting of said seat frame and said back frame is up to about 15° relative to said transport frame.

5. A mobile transport device according to claim 1 wherein said axial off-set extension extends outwardly at an angle of between about 5° and about 12°.

6. A mobile transport device according to claim 1 wherein each of said slide tube includes a front end opening and a back end having a transverse pivot hole and said tubular journal includes an annular lip disposed at one end that has an outer diameter that is larger than said internal diameter of said hollow support tube.

7. A mobile transport device according to claim 1 wherein said slide tube is slidingly positioned within said tubular journal, and both are received at said back end of said hollow support tube so that said slide tube is axially slidable within said hollow support tube and guided by tubular journal.

8. A mobile transport device according to claim 7 comprising a plug including an annular lip disposed at one end and an outer diameter that is larger than said internal diameter of said slide tube, but smaller than an internal diameter of said hollow support tube, and is positioned in a front end opening of said slide tube.

9. A mobile transport device according to claim 1 wherein each of said lower link beams each comprise a rod having a front end, a rear end, and a pair of spaced-apart transverse pivot holes located adjacent to said front end and said rear end, and has a length that is approximately equal to a fully contracted length of said telescoping beam.

10. A mobile transport device according to claim 9 wherein said seat frame is operatively mounted to said powered drive at a portion of said lower link beam so that as said lower link beam is moved, front toggle beam and rear toggle beam pivot thereby allowing said telescoping beams to lengthen relative to said link beams.

11. A mobile transport device according to claim 8 wherein said hollow support tube is drawn away from said slide tube such that said lip of said plug moves along an internal surface of said hollow support tube.

12. A mobile transport device adapted to be transformed from a first position suitable for supporting a seated patient to a second position suitable for supporting a reclining patient at the same height as a patient bed comprising:

a pair of spaced-apart side frames;

a back frame including a pair of spaced-apart support members each having an axially off-set extension located at a bottom end wherein each of said axial off-set extensions extends outwardly at an angle of between about 5° and about 12°;

a seat frame pivotally supported upon said pair of spaced-apart side frames, said seat frame including a pair of spaced-apart telescoping beams comprising an assembly including a hollow support tube having a slide tube supported within by a tubular journal that is located within an open end of said hollow support tube wherein said hollow support tube includes a transverse pivot hole adjacent to a front end and spaced-away from a back end such that said hollow slide tube has an outer diameter that is smaller than an internal diameter of both said tubular journal and said hollow support tube, while said tubular journal has an outer diameter that is slightly smaller than an internal diameter of said hollow support tube, and wherein said pair of spaced-apart telescoping beams are arranged in substantially parallel relation to said pair of spaced-apart side frames, each of said telescoping beams having a front end and a rear end, and being capable of changing length wherein each of said front ends is pivotally mounted upon a portion of an adjacent side frame, and each of said rear ends is pivotally mounted upon a portion of a respective one of said axially off-set extensions;

a pair of spaced-apart lower link beams each having a front end and a rear end that are each pivotally engaged with a respective one of said telescoping beams by a front toggle beam and a rear toggle beam; and a powered drive operatively supported between said pair of spaced-apart side frames and operatively engaged with said seat frame so as to move said seat frame and said back frame between (i) said first position wherein said seat frame and said back frame are oriented so as to be suitable for supporting a seated patient, wherein said telescoping beam is at its shortest length; and (ii) said second position wherein said seat frame and said back frame are oriented so as to be suitable for supporting a reclining patient at the same height as a patient bed wherein said telescoping beam is at its longest length.

13. A mobile transport device according to claim 12 wherein each of said slide tube includes a front end opening and a back end having a transverse pivot hole and said tubular journal includes an annular lip disposed at one end that has an outer diameter that is larger than said internal diameter of said hollow support tube.

14. A mobile transport device according to claim 13 wherein said slide tube is slidingly positioned within said tubular journal, and both are received at said back end of said hollow support tube so that said slide tube is axially slidable within said hollow support tube and guided by tubular journal.

15. A mobile transport device according to claim 14 comprising a plug including an annular lip disposed at one end and an outer diameter that is larger than said internal diameter of said slide tube, but smaller than an internal diameter of said hollow support tube, and is positioned in a front end opening of said slide tube.

16. A mobile transport device according to claim 15 wherein each of said lower link beams each comprise a rod having a front end, a rear end, and a pair of spaced-apart transverse pivot holes located adjacent to said front end and said rear end, and has a length that is approximately equal to a fully contracted length of said telescoping beam.

17. A mobile transport device according to claim 16 wherein said seat frame is operatively mounted to said powered drive at a portion of said lower link beam so that as said lower link beam is moved, front toggle beam and rear toggle beam pivot thereby allowing said telescoping beams to lengthen relative to said link beams.

18. A mobile transport device according to claim 17 wherein said hollow support tube is drawn away from said slide tube such that said lip of said plug moves along an internal surface of said hollow support tube.

19. A mobile transport device adapted to be transformed from a first position suitable for supporting a seated patient to a second position suitable for supporting a reclining patient at the same height as a patient bed comprising:

a pair of spaced-apart side frames pivotally supported upon a wheeled transport frame;

a back frame including a pair of spaced-apart support members each having an axially off-set extension located at a bottom end wherein each of said axial off-set extensions extends outwardly at an angle of between about 5° and about 12°;

a seat frame pivotally supported upon said pair of spaced-apart side frames, said seat frame including a pair of spaced-apart telescoping beams comprising an assembly including a hollow support tube having a slide tube supported within by a tubular journal that is located within an open end of said hollow support tube wherein said hollow support tube includes a transverse pivot hole adjacent to a front end and spaced-away from a back end such that said hollow slide tube has an outer diameter that is smaller than an internal diameter of both said tubular journal and said hollow support tube, while said tubular journal has an outer diameter that is slightly smaller than an internal diameter of said hollow support tube, and wherein each of said telescoping beams has a front end and a rear end and is capable of changing length wherein each of said front ends is pivotally mounted upon a portion of an adjacent side frame, and each of said rear ends is pivotally mounted upon a portion of a respective one of said axially off-set extensions;

a pair of spaced-apart lower link beams each having a front end and a rear end that are each pivotally engaged with a respective one of said telescoping beams by a front toggle beam and a rear toggle beam; and a powered drive operatively supported between said pair of spaced-apart side frames and operatively engaged with said seat frame so as to move said seat frame and said back frame between (i) said first position wherein said seat frame and said back frame are oriented so as to be suitable for supporting a seated patient, wherein said telescoping beam is at its shortest length; and (ii) said second position wherein said seat frame and said back frame are oriented so as to be suitable for supporting a reclining patient at the same height as a patient bed wherein said telescoping beam is at its longest length.

* * * * *